United States Patent [19]

Grossbard

[11] Patent Number: 4,555,916

[45] Date of Patent: Dec. 3, 1985

[54] STEP-CUT STONE WHICH HAS BEEN BRILLIANTIZED

[76] Inventor: Henry Grossbard, 552 Beach 132 St., Belle Harbor, N.Y. 11694

[21] Appl. No.: 400,088

[22] Filed: Jul. 20, 1982

[51] Int. Cl.[4] ..... A44C 17/00

[52] U.S. Cl. ..... 63/32

[58] Field of Search ..... 63/32; D11/90

[56] References Cited

U.S. PATENT DOCUMENTS 4,020,649 5/1977 Grossbard ..... 63/32

OTHER PUBLICATIONS

Long et al., "Facet Design", vol. 4, publ. in pamphlet form by authors at Seattle, Wash., Nov. 1981, pp. B-11,13,15,21.

*Primary Examiner*—F. Barry Shay

*Attorney, Agent, or Firm*—Roberts, Spiecens & Cohen

[57] ABSTRACT

A step-cut stone with a straight edged polygonal shaped girdle comprising: a generally pyramidal base which is provided with kite-shaped facets extending from the culet toward the vertices of the girdle and ridges along lines between the culet and the middle of edges of the girdle; and a crown with at least girdle and table breaks wherein at least one of these breaks is cut with triangular shaped facets.

9 Claims, 6 Drawing Figures

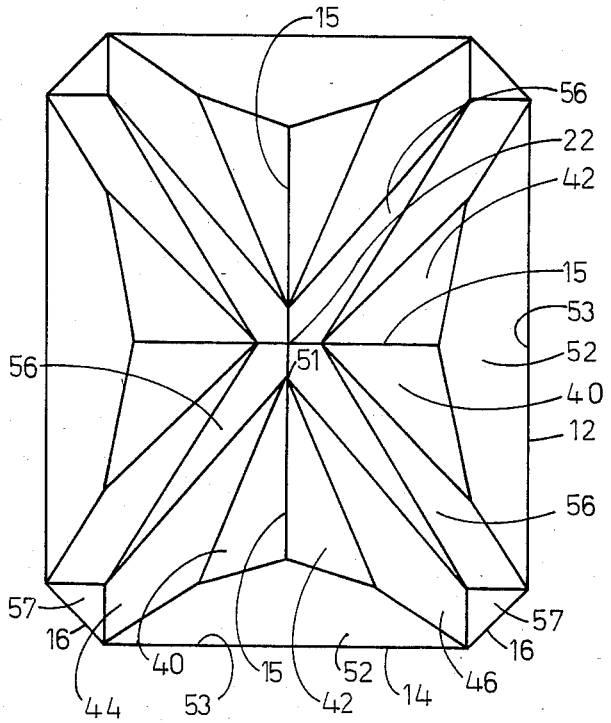
FIG. 4
FIG. 5
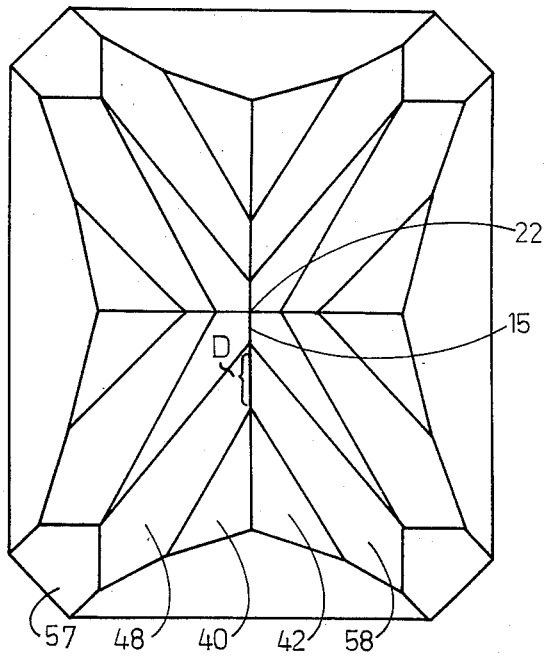
FIG. 6
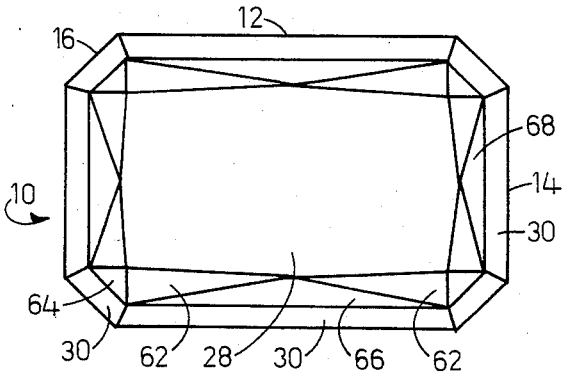

STEP-CUT STONE WHICH HAS BEEN BRILLIANTIZED

BACKGROUND OF THE INVENTION

The invention pertains to cut stones and, more particularly, to gem stones such as diamonds.

It is known that the brilliant cut maximizes the fire of a diamond. For this reason such a cut is by far the most popular. However, the cut is the most wasteful of diamond raw material.

On the other hand, step cut stones such as square cut diamonds and emerald cut diamonds while being more conservative of diamond raw material have none of the fire of brilliant cut diamonds. These facts have been known to the diamond trade for a long time and attempts have been made to devise hybrid cuts to capture the advantages of the square and brilliant cut diamonds.

One such hybrid is shown and described in U.S. Pat. No. 3,796,065 for a stone with an emerald cut crown and a modified brilliant cut base. While such a stone has more brilliance than the conventional square or emerald cut stones, it does not approach the brilliance of a brilliant cut stone.

Another such hybrid is shown and described in my U.S. Pat. No. 4,020,649. This hybrid has become very popular since it closer approaches the fire, brilliance, and life of a brilliant cut stone with a saving in weight over the stone of U.S. Pat. No. 3,796,065.

However, there are instances when the hybrid of U.S. Pat. No. 4,020,649 is less than satisfactory. In particular, when one is dealing with colored diamonds which have very deep culets one obtains less than optimum brilliance and fire. In addition, for smaller stones while there is considerable weight saving with the cut of the hybrid of my U.S. Pat. No. 4,020,649, there is still a need for more weight saving.

SUMMARY OF THE INVENTION

It is accordingly a general object of the invention to provide a diamond which is, on the one hand, more brilliant than the heretofore known conventional or hybrid square or emerald cut colored diamonds and, on the other hand, is less wasteful of raw material than conventional brilliant cut or the afore-mentioned hybrid cut diamonds.

Briefly, the invention contemplates a step cut diamond having: a straight edged polygonal shaped girdle; a crown having a girdle break, a table break and a table, wherein at least one of the breaks of the crown is cut with triangular shaped facets; and a generally pyramidal base having a girdle break, a culet break, and a culet wherein kite-shaped facets extend between the culet and the vertices of the girdle and ridges generally extend along lines between the culet and the midpoints of the straight edges of the girdle.

BRIEF DESCRIPTION OF THE DRAWING

Other objects, the features and advantages of the invention will be apparent from the detailed description when read with the accompanying drawing which shows by way of example the presently preferred embodiments of the invention wherein:

FIG. 4 is a bottom view of a diamond with a base cut in accordance with another embodiment of the invention;

FIG. 5 is a bottom view of a diamond with a base cut in accordance with a further embodiment of the invention; and FIG. 6 is a top view of a diamond having a crown cut in accordance with any embodiment of the invention.

DESCRIPTION OF THE PREFERRED EMBODIMENTS

Figure 1:
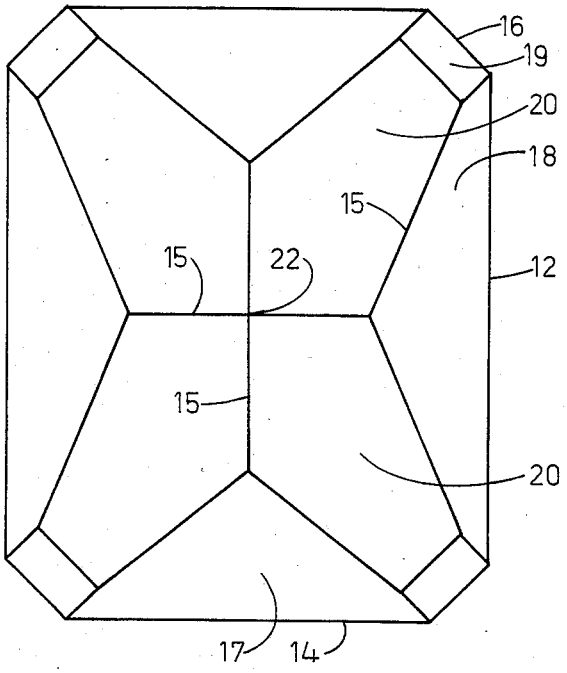
FIGS. 1 and 2 show the top and bottom views respectively of a diamond according to the invention in an early stage of cutting.
Figure 2:
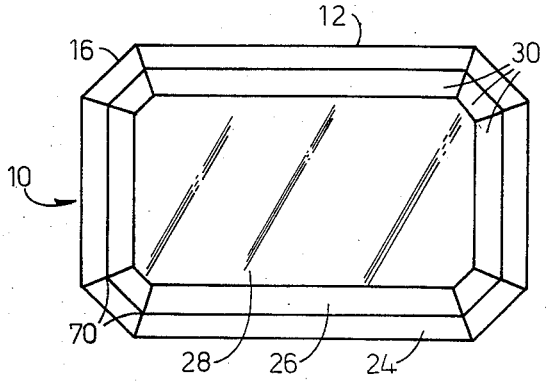

FIGS. 1 and 2 show a step cut diamond 10 having: an octagonal girdle with straight edge long side facets 12, straight edge short side facets 14 and straight edge corner facets 16; a pyramidal base having short side girdle breaks 17, long side girdle breaks 18, corner girdle breaks 19, culet breaks 20, and a culet 22, the abutting of the culet breaks 20 define ridges 15; and a crown having a girdle break 24, a table break 26 and a table 28. The two breaks of the crown should be of approximately equal width. In addition, the angle between the plane of the girdle break of the crown and the table should be in the range from 35° to 45°.

The angle between the plane of the table and the plane of the girdle breaks of the base is from 50° to 62°. The angle between the plane of the culet break and the plane of the table is from 33° to 42°. (However, it should be noted that the angle for all culet breaks is the same regardless of the squareness of the stone i.e., the angle of the culet break on a long side is the same as the angle of a culet break on the short side.)

The diamond 10 as shown and described with respect to FIGS. 1 and 2 is now brilliantized by further cutting of the base and crown.

Figure 3:
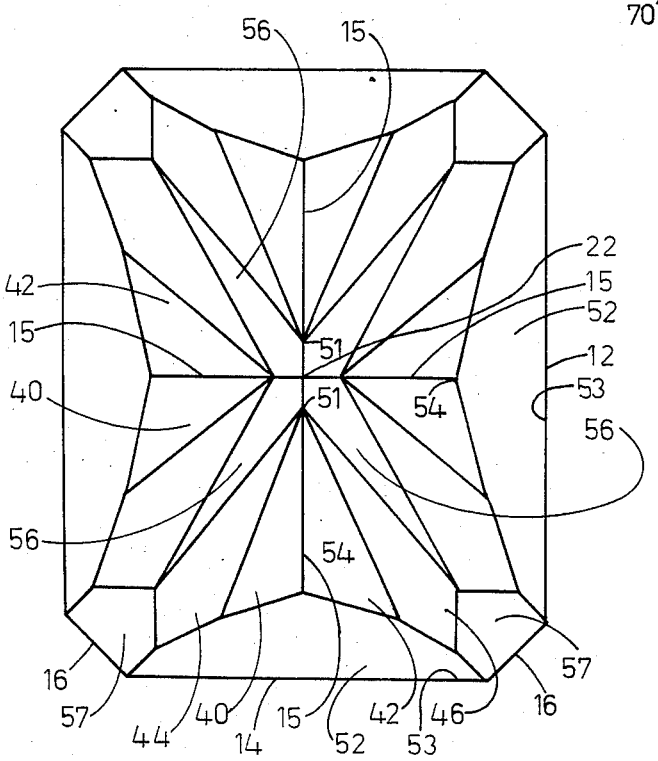
FIG. 3 is a bottom view of the base of a diamond cut in accordance with one embodiment of the invention.

The base is cut with a fan of four halves cut symmetrically in pairs about each ridge 15. These ridges 15 extend along lines between culet 22 and toward the mid-points of the straight edge side facets 12 and 14. In particular, it has been found for enhancing the brilliance to symmetrically place two pairs of halves about each of the ridges 15. As shown in FIGS. 3 and 4 two pairs of halves are disposed symmetrically about each ridge 15, this being the most preferred number of pairs. More specifically, the first pair comprises halves 40 and 42, which are always triangles; the second pair comprises halves 44 and 46 which for these embodiments are kite-shaped, while for the embodiment of FIG. 5 they are irregular pentagonal shaped. Note in the embodiments of FIGS. 3 and 4 the vertices of the halves nearest the culet all meet at a point 51, while in the embodiment of FIG. 5 there is a displacement D along the ridge 15 between the meetings of the pairs. As a result of this faceting culet breaks 20 now become kite-shaped facets 56, while corner girdle breaks 19 become corner facets 57. After the cutting of the fans, side girdle breaks become shield facets 52 with base 53 colinear with the girdle, and apices 54 in contact with the ridges 15.

The corner facets 57 also vary with the ratios of the dimension of the stone. In every case, the facet is a polygon having from three to five sides. The embodiment of FIG. 4 shows a triangle while those of FIGS. 3 and 5 are irregular pentagons. In some cases, as will be apparent to those skilled in the art, it will be desirable for the facet to be irregularly quadrilateral.

The above-described base in accordance with the invention can be used with many crowns. For example, the base can be used with the crown shown and described in FIG. 2. The base can also be used with the conventional emerald cut crown. However, to obtain even more brilliance one should further face the crown of FIG. 2. The preferred cut is shown in FIG. 6. There are cut a pair of star facets into each side of the table break 24 of the crown. Thus, the original eight "rectangular" facets 30 of the table break 26 (see FIG. 3) are transformed to sixteen triangular facets of which eight are the star facets 62, four are triangular facets 64 in the corners, two are triangular facets 66 in the long sides and two are triangular facets 68 in the short sides. These triangular facets enhance the brilliance of the diamond 10 by interplaying with the facets of the base.

There has thus been shown a step cut diamond, which can range from a square cut to rectangular cut and which has a brilliancy approaching the brilliancy of brilliant cut or round diamonds for fancy colors with nowhere near the usual loss of raw material. In addition, the disclosed diamond makes it possible to achieve a point culet on a longer than usual rectangular stone. Furthermore, the invention permits a much greater conservation of weight. Such conservation is very important when cutting small stones.

While only a limited number of embodiments of the invention has been shown and described in detail, there will now be obvious to those skilled in the art many modifications and variations satisfying many or all of the objects of the invention but which do not depart from the spirit thereof as defined by the appended claims. For example, although there has been shown only a rectangular cut stone, the invention contemplates any straight edged polygon stone such as regular or irregular hexagonal stones, truncated kite-shaped stones, pentagons, etc.

What is claimed is:

1. A step cut diamond comprising: a straight-edged polygonal-shaped girdle having straight-edged corners connecting adjacent pairs of straight, mutually, perpendicular edges of said girdle; a crown having a table, a table break and a girdle break, said table break having triangular facets; and a pyramidal base having a girdle break, a culet, a culet break, kite-shaped facets extending from said culet toward the straight-edged corners of said girdle, four corner facets each having one edge coincident with the straight edge of a respective one of said straight-edged corners and a vertex abutting a vertex of the adjacent kite-shaped facet, shield-shaped facets which are part of the girdle break having bases on straight edges of the girdle and apices extending toward said culet, ridges extending along straight lines between said culet and the apices of said shield-shaped facets, and a fan of at least two pairs of halves symmetrically disposed about each ridge, the halves of the pair adjacent to the ridge being triangular facets, and the halves of the pair remote from said ridge being similar polygonal facets with at least four sides, said kite-shaped, corner and shield-shaped facets and said fans being symmetrically arranged about said culet, each of said corner facets having a side in common with one of said shield-shaped facets.

2. The step-cut diamond of claim 1 wherein the halves of the pair remote from the associated ridge being kite-shaped for at least two opposite ridges.

3. The step-cut diamond of claim 1 wherein the halves of the pair remote from the associated ridge being irregular pentagons for at least two opposite ridges.

4. The step-cut diamond of claim 2 wherein the vertices of said halves in the region of said culet meet at a point.

5. The step-cut diamond of claim 3 wherein the vertices of one pair of said halves in the region of said culet coincide in a point which is displaced along the associated ridge from the vertices of the other pair of said halves.

6. The step-cut diamond of claim 1 wherein at least some of said polygonal facets are pentagons.

7. The step-cut diamond of claim 1 wherein the plane of a girdle break of the base makes an angle of from 50° to 62° with the plane of the table.

8. The step cut diamond of claim 1 or 7 wherein the plane of the culet break makes an angle of from 31° to 42° with the plane of table.

9. The step cut diamond of claim 1 wherein at least some of said polygonal facets are irregular quadrilaterals.

* * * * *